US006461409B1

(12) United States Patent
Neff et al.

(10) Patent No.: US 6,461,409 B1
(45) Date of Patent: Oct. 8, 2002

(54) DEVICE AND METHOD FOR TREATING FLOWING GASES, IN PARTICULAR EXHAUST GASES

(75) Inventors: Willi Neff, Kelmis (BE); Klaus Pochner, Rüsselsheim-Bauschheim (DE); Franz-Josef Trompeter, Aachen (DE); Jens Kamp, Erkelenz (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 0 days.

(21) Appl. No.: 09/673,967

(22) PCT Filed: Mar. 24, 2000

(86) PCT No.: PCT/EP00/02627

§ 371 (c)(1),
(2), (4) Date: Dec. 6, 2000

(87) PCT Pub. No.: WO00/57992

PCT Pub. Date: Oct. 5, 2000

(30) Foreign Application Priority Data

Mar. 25, 1999 (DE) ..... 199 13 614

(51) Int. Cl.[7] ..... B03C 3/36
(52) U.S. Cl. ..... 95/78; 96/62; 96/69; 96/73
(58) Field of Search ..... 96/97, 60, 64, 96/62, 69, 99, 73, 79, 86, 87; 95/78; 55/DIG. 39

(56) References Cited

U.S. PATENT DOCUMENTS

| | | | | | |
|---|---|---|---|---|---|
| 2,978,066 | A | * | 4/1961 | Nodolf | 96/87 |
| 3,690,043 | A | * | 9/1972 | Futterer et al. | 96/64 |
| 3,768,258 | A | * | 10/1973 | Smith et al. | 96/97 X |
| 3,795,605 | A | * | 3/1974 | Candor | 55/DIG. 39 |
| 3,898,408 | A | * | 8/1975 | Cookson et al. | 96/99 X |
| 4,216,000 | A | * | 8/1980 | Kofoid | 96/99 X |
| 4,277,258 | A | * | 7/1981 | Bojsen | 96/97 |
| 4,477,268 | A | * | 10/1984 | Kalt | 96/99 |
| 5,055,118 | A | * | 10/1991 | Nagoshi et al. | 96/99 X |
| 5,100,440 | A | * | 3/1992 | Stahel et al. | 96/97 |
| 5,215,558 | A | * | 6/1993 | Moon | 96/64 X |
| 5,582,632 | A | * | 12/1996 | Nohr et al. | 95/78 |

FOREIGN PATENT DOCUMENTS

| | | | |
|---|---|---|---|
| DE | 43 17 964 | 12/1994 | |
| DE | 195 18 970 | 11/1996 | |
| DE | 196 16 197 | 11/1997 | |
| EP | 0 158 823 | 10/1985 | |
| WO | 97/40265 | * 10/1977 | 96/99 |
| WO | 96/37690 | * 11/1996 | 96/99 |
| WO | WO 98/48922 | 11/1998 | |

* cited by examiner

*Primary Examiner*—Richard L. Chiesa
(74) *Attorney, Agent, or Firm*—Crowell & Moring LLP

(57) ABSTRACT

A device for the treatment of a flowing gas, such as an exhaust gas, includes at least one pair of smooth electrodes that are arranged opposite each other so that they form between them a discharge space through which a gas flows. For each pair of electrodes, at least one electrode is coated with a dielectric material on a side facing the discharge space. At least one electrode has one or more thickened areas facing the discharge space. The one or more thickened area has at least one opening through which the gas can flow. A device may be used in the cleaning of exhaust gases from internal combustion engines of motor vehicles as well as the cleaning of waste gases of power plants or waste incinerating plants.

7 Claims, 4 Drawing Sheets

DEVICE AND METHOD FOR TREATING FLOWING GASES, IN PARTICULAR EXHAUST GASES

TECHNICAL FIELD

The invention relates to a device and a process for the treatment of flowing gases, and in particular flowing exhaust gases. The invention can be used in all fields of technology, where flowing gases are subjected to an aftertreatment in order to reduce hazardous substances, for example in the automobile industry, in power plants or waste incinerating plants or where gases are to be converted by plasma chemistry into new substances, such as in the production of ozone from oxygen.

BACKGROUND OF THE INVENTION

The present invention is an advantageous advancement over DE 195 18 970 C1.

To increase the efficiency in cleaning flowing gases by means of barrier discharges, DE 195 18 970 C1 proposed that the electrode surface exhibit nonhomogeneity along the flow direction of the gas. This nonhomogeneity, namely thickening, can increase the probability of the discharge filaments igniting even in those gas volumes where no discharge has taken place yet. In the thick spots, the electrodes are spaced apart at shorter distance. Thus, the electric field strengths are higher between the electrodes. Therefore, the discharge ignites exclusively in the thick spots. If there are altogether adequate number of thick spots, more volume elements can be exposed altogether to a discharge filament, a feature that increases the efficiency.

Our own studies have revealed that the solution proposed in DE 195 18 970 C1 exhibits the drawback that electric charge carriers in the thick spot decrease the local ignition voltage. The nonhomogeneity of the electrode surface also results namely in a nonhomogeneity of the distribution of the electric charge carriers. Since the discharge ignites exclusively in the thick spots, the result in these areas is an accumulation of electric charge carriers and thus a decrease in the ignition field strength.

This negative effect results in not only the filaments igniting on the surface of the thickening facing the counter electrode when charge carriers are present in the thick spot, but also in the filaments now igniting by a longer path, for example on the side faces of the thickenings.

In those spatial areas, which lie behind the thickenings based on the direction of flow, there is hardly any gas flow. Thus, the result of the thickenings is a volume area V1, where no significant gas exchange takes place any more.

The ignition of filaments on the side faces of the thickenings, and the circumstance that in volume V1 no significant gas exchange takes place any more, result in the gas discharge in volume V1 having virtually no effect. Depending on the geometric shape of the thickenings, their number and their configuration in the reactor, a significant portion of the energy coupled into the gas discharge is unused. Thus, the potential for the efficiency of the barrier discharge is not exhausted.

Another drawback of the thickenings lies in the fact that the gas flow is severely impeded by the discharge slit, which is only a few millimeters large and is formed by the electrodes. The increased flow resistance is a drawback for all aforementioned applications and can result, for example in internal combustion engines, in a backup of the exhaust gases and thus to a deterioration of the engine performance.

For this reason it is desirable to dimension the discharge slit as large as possible. However, the resulting required enlargement of the electrode spacing makes it necessary to increase the voltage amplitude generated by the voltage source. However, the increased cost for insulation and voltage generators does not support this step.

The invention is based on the problem of overcoming the drawbacks of DE 195 18 970 C1 and providing an exhaust gas reactor wherein the flow of exhaust gas through the volume occupied by the gas discharge is as comprehensive as possible.

Furthermore, the object of the invention is to decrease the flow resistance of the discharge slit. In so doing, the flow resistance is supposed to be decreased without enlarging the discharge slit.

It was recognized, according to the invention, that the problems arising from DE 195 18 970 C1 can be solved with thickenings that exhibit at least one opening through which the exhaust gas can flow.

The openings are affixed in such a manner that the exhaust gas can flow through the opening. Thus, there is spatially behind the thickenings a gas flow or gas exchange, based on the direction of flow. In this space, flowing gas is exposed to the discharge filaments. Thus, there is virtually comprehensive exhaust gas flow through the volume occupied by the gas discharge and the cleaning effect is improved. In exhaust gas reactors in everyday practice, the volume swept by the discharge filaments is approximately doubled and the cleaning effect increases proportionally by approximately 100%.

In the context of the present invention it can be desirable to provide only one part of the thickenings with openings, when the flow behavior in the respective application demands it. One or more openings are possible per thickening. For optimal gas flow, it is expedient to align the openings parallel to the direction of flow. This can be done, for example, by drilling with a laser one or several holes, whose axis of symmetry lies largely parallel to the direction of flow, into the thickening. The width of the openings is dimensioned in such a manner that it is certain that the discharge filaments will also ignite over the path elongated by this width.

Should the flow resistance and the cleaning effect be adequate for the application, the invention can also serve to use smaller voltage amplitudes than in a prior art reactor. For a cleaning effect that is just as good compared to the prior art, the discharge slit can be decreased to the point that the cross sectional area, through which the gas flows and which is formed by the sum of the cross sectional areas of the discharge slit and the openings, remains constant. This feature is especially advantageous for cleaning the exhaust gas of internal combustion engines, where it is then possible to work advantageously with lower voltages so that less expensive and more compact voltage sources can be chosen.

Without restricting the general idea of the invention the inventive advancement shall be explained with reference to the embodiments.

BRIEF DESCRIPTION OF THE DRAWINGS

FIG. 1 depicts an exhaust gas reactor, according to DE 195 18 970 C1, with two smooth electrodes (1) and (2), where the upper electrode (1) is coated with a dielectric material (3). The gas flows, for example, from left to right. The bottom electrode (2) exhibits thickenings (4). The thickenings are formed in such a manner that there are no sharp peaks or edges in order to avoid passing into a corona discharge. As our own studies have shown, the gas flows virtually exclusively in the region above the thickenings (4). This region is located above the horizontal, dashed line (5) in FIG. 1. In the volume below this dashed line and thus behind the thickenings, there is only negligible gas flow. In the slit (6) between the electrode (1) and the thickening (4) the discharge filaments (7), depicted with a dashed line, are formed when high voltage U is applied to the electrodes.

FIG. 2 is a detailed view of a single thickening in the exhaust gas reactor, according to DE 195 18 970 C1. As a consequence of the accumulation of charge carriers in the slit (6), the ignition voltage decreases so that discharges also occur that take place on a longer path (8). Below the dashed line (5), however, there is no significant gas flow. Thus, there exists a volume V1, where there are, indeed, discharge filaments, but no gas flow. Thus, the flow of exhaust gas through the volume occupied by the gas discharge is quite incomplete.

FIG. 3*a* depicts the solution according to the invention. In contrast to the solid thickening of FIG. 2, this electrode is now provided, i.e. punctured, with openings (9), in the vicinity of the discharge slit. The openings are inserted in such a manner that the exhaust gas can flow through the openings. The openings were introduced in such a manner with a laser beam into the thickening that the borehole axes run largely parallel to the direction of flow.

FIG. 3*b* is a detailed view of the openings (9), here three openings, in the viewing direction of the direction of flow. Owing to the solution of the invention, the ignition field strength remains constant due to the unchanged distance between the thickening and the smooth counter electrode. However, the flow resistance decreases, since now the gas can also flow through the openings or the perforations. The width of the openings is dimensioned in such a manner that it is also certain that the discharge filaments will ignite over the path elongated by this width. Thus, optimal overlapping between the flowing gas and the volume swept by the barrier discharge is produced. The legs (10) and (11) should be as narrow as possible in order to bring about negligible flow resistance. Through the vertical legs (11), between the openings, the electric current must flow to the horizontal leg (10) i.e. the thick spot above the openings (9), and from there over the filaments of the barrier discharge to the opposite dielectric material. The reciprocal distance between the vertical legs (11) must be dimensioned in such a manner that the horizontal leg (10) is ndt deformed, for example, by thermal expansion.

FIG. 3*c* is a side view (gas flow from left to right) of a thickening (4), which is sloped at least partially relative to the counter electrode (bent thickening). The filaments are ignited first by the shortest path, i.e. in the discharge slit (6*a*) at the leg. As the ignition voltage decreases, the next ignition takes place by the longer path below the opening (9) offset to the side of the direction of flow. That is, another discharge slit (6*b*) is formed. Owing to this lateral displacement a larger dielectric area is available to the discharge so that the gas discharge can absorb even more power per thickening than in the case of a thickening without bend. Depending on the choice of openings, at least two discharge slits are produced.

FIG. 4*a* and FIG. 4*b* are sectional views of two reactors, which are designed coaxially and are realized according to the invention. In both cases the smooth electrode (1) consists of a tube with insulation (3), illustrated by dots. The insulation is made of quartz glass or an aluminum oxide ceramic. The thickenings (4) on the electrode (2) are metallic disks with openings (9). The gas flows parallel to the cylinder axis through the discharge slit (6) and through the openings (9). In this embodiment, too, there are narrow legs (11) between the individual openings in the disks. Said legs have the task of guaranteeing the flow to the leg (10), formed in the direction of the discharge slit (6), and at the same time mechanically stabilizing this leg.

LIST OF REFERENCE NUMERALS

Figure 1:
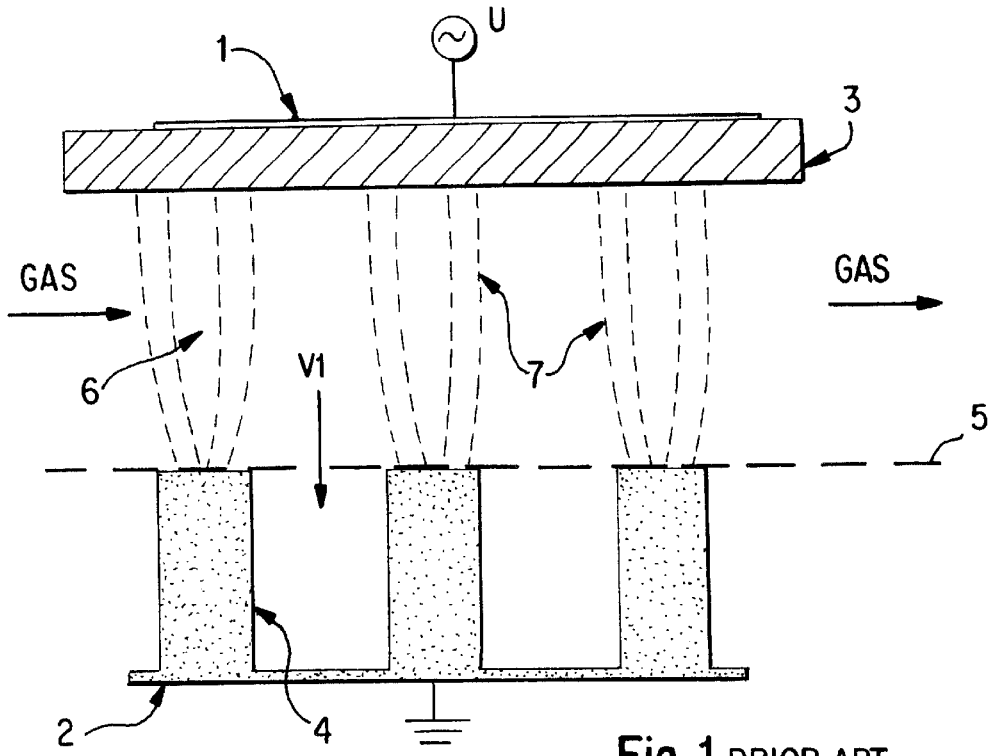
Fig.1 PRIOR ART
FIG. 1 shows a schematic representation of an exhaust gas reactor according to the art.
Figure 2:
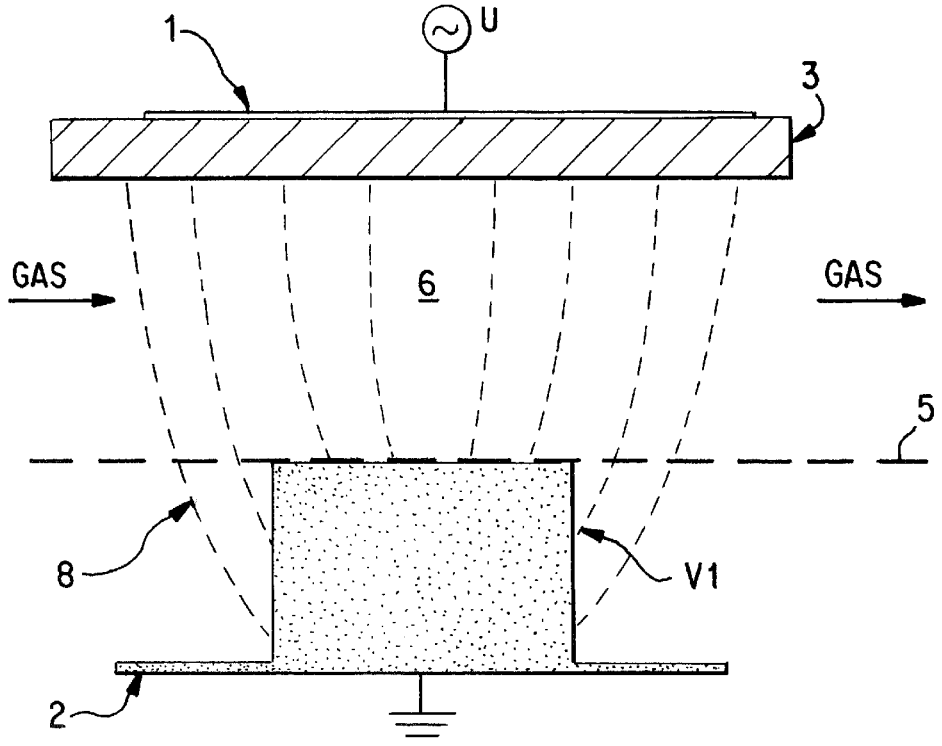
Fig.2 PRIOR ART
FIG. 2; is a detailed view of a single thickening in the exhaust gas reactor of FIG. 1.
Figure 3A:
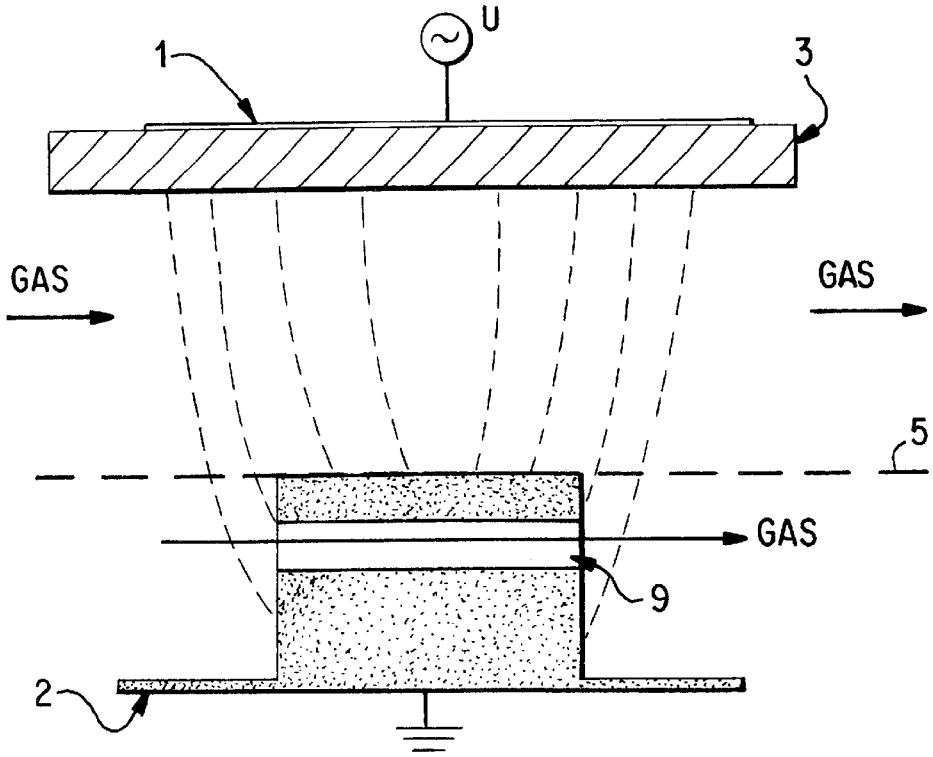
FIG. 3*a* shows a thickening according to the present invention.
Figure 3B:
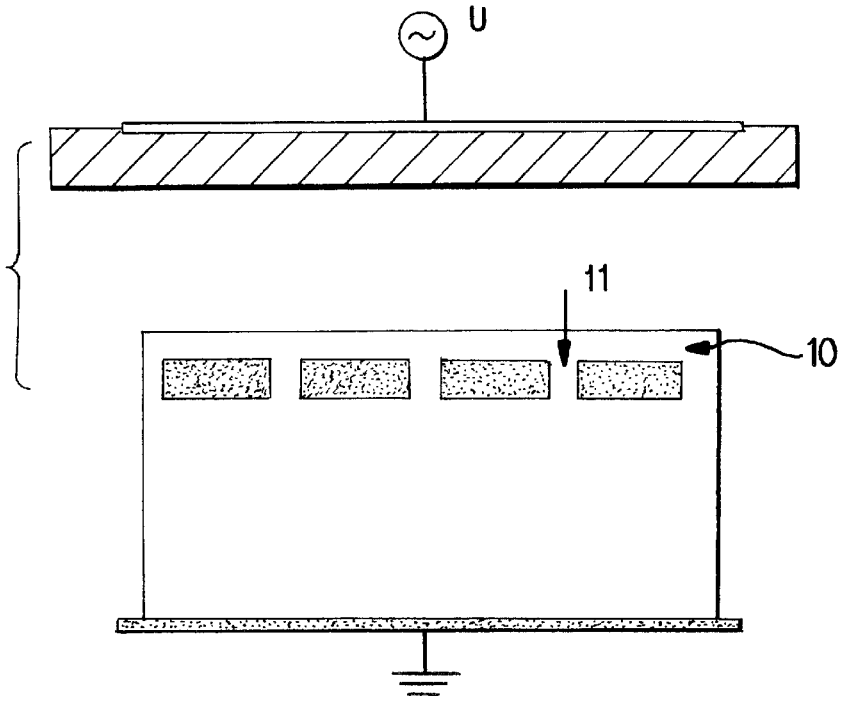
FIG. 3*b* is a detailed view of the openings of FIG. 3*a;*
Figure 3C:
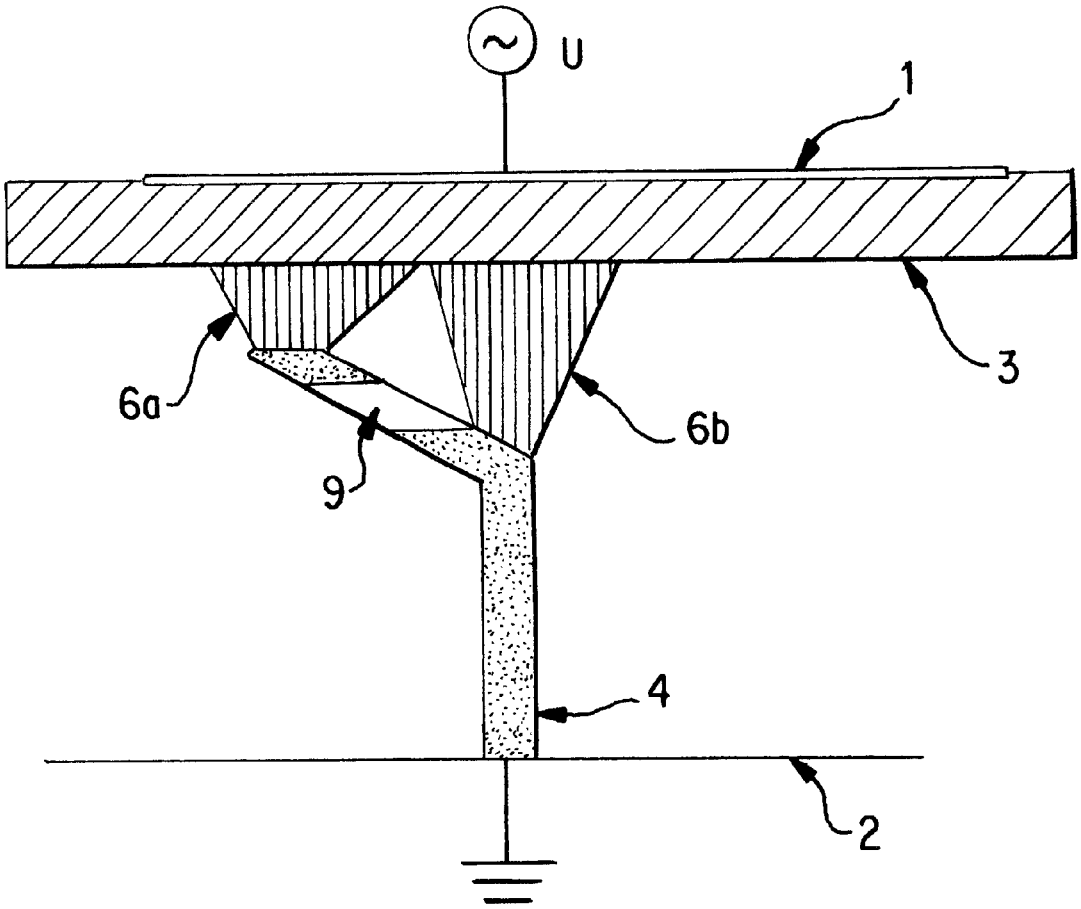
FIG. 3*c* is a side view of a sloped thickening according to the present invention.
Figure 4B:
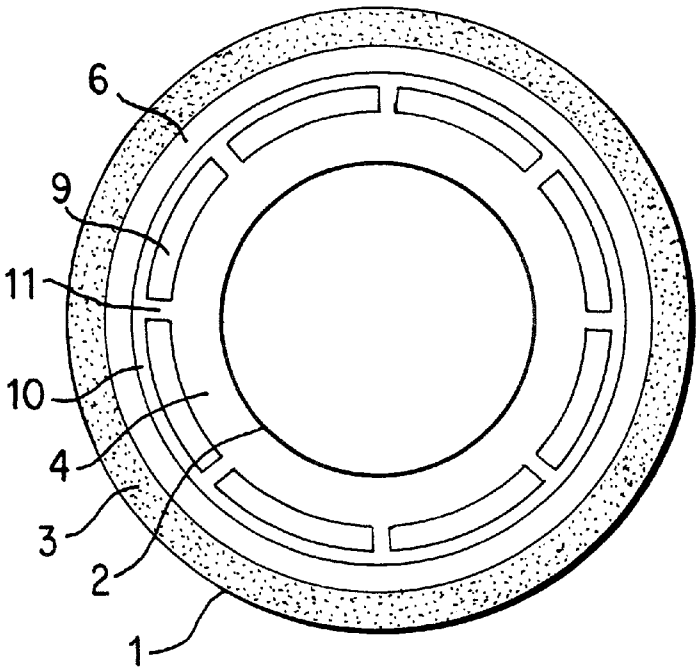
FIGS. 4*a*–4*b* are sectional views of two reactors that are designed coaxially according to the present invention.
Figure 4A:
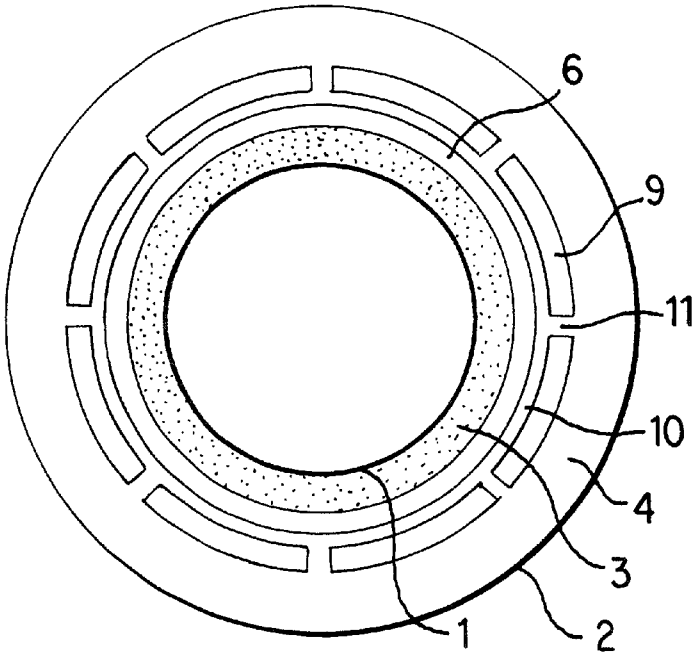

1,2 electrodes
3 dielectric material
4 thickening
5 dashed line
6 discharge slit
7 discharge filament by the shortest path
8 discharge filament by a longer path
9 opening
10 horizontal leg (thick spot above the openings)
11 vertical leg (thick spot between the openings)

What is claimed is:

1. A device for treatment of a flowing gas, comprising:

at least one pair of smooth electrodes arranged opposite each other so that a discharge space is formed therebetween through which a gas to be treated flows, wherein at least one electrode is coated with a dielectric material on a side facing the discharge space, wherein at least one electrode has one or more thickened areas facing the discharge space and extending into the discharge space, wherein the one or more thickened areas has at least one opening defining a flow channel through the thickened area, the flow channel oriented substantially in a same direction as a flow direction of the gas to be treated in the discharge space and having a top wall and a bottom wall within the thickened area, through which at least a portion of the gas to be treated can flow.

2. A device according to claim 1, wherein the flowing gas is an exhaust gas.

3. A device as claimed in claim 1, wherein the thickened area slopes at least partially relative to a counter electrode.

4. A device as claimed in claim 1, wherein the at least one opening runs essentially parallel to a flow direction of the gas.

5. A process for the treatment of a flowing gas, comprising:

flowing a gas to be treated through a discharge space with an electric field;

flowing at least a portion of the gas to be treated through an opening defining a flow channel located in a thickened area of an electrode facing the discharge space, the thickened area extending into the discharge space and the flow channel oriented substantially in a same direction as a flow direction of the gas to be treated in the discharge space and having a top wall and a bottom wall within the thickened area; and generating electric discharges.

6. A process according to claim 5, wherein the flowing gas is an exhaust gas.

7. A process according to claim 5, wherein the gas in the opening flows essentially parallel to the gas in the discharge space.

* * * * *